United States Patent [19]

Viles

[11] Patent Number: 4,906,205

[45] Date of Patent: Mar. 6, 1990

[54] JUMPER CABLE SAFETY MEANS

[75] Inventor: Richard P. Viles, Cloverdale, Ind.

[73] Assignee: Stephen C. Burgess, Anderson, Ind.

[21] Appl. No.: 264,538

[22] Filed: Oct. 31, 1988

[51] Int. Cl.[4] ..... H01R 11/00

[52] U.S. Cl. ..... 439/504; 439/289; 320/25

[58] Field of Search ..... 439/503–506, 439/289; 320/25, 26

[56] References Cited

U.S. PATENT DOCUMENTS

| | | | |
|---|---|---|---|
| 1,392,558 | 10/1921 | Darrah et al. | 439/289 |
| 1,394,057 | 10/1921 | Woernley | 439/289 |
| 4,157,492 | 6/1979 | Colbrese | 439/504 |
| 4,272,142 | 6/1981 | Zapf | 439/504 |
| 4,366,430 | 12/1982 | Wright | 320/25 |
| 4,721,479 | 1/1988 | Shuman | 439/504 |

*Primary Examiner*—P. Austin Bradley

*Attorney, Agent, or Firm*—Robert A. Spray

[57] ABSTRACT

A set of jumper cables for a "battery-jumping" procedure, having intermediately of the battery-containing ends an electrical switch device by which electrical conductivity of the cables is blocked except when the user, in a position of safety removed from the location of connection of the cables to either battery, moves the switch components to electrically-conducting condition by manual manipulation at such position of safety away from the location of either battery.

17 Claims, 2 Drawing Sheets

JUMPER CABLE SAFETY MEANS

The present invention relates to a set of so-called "jumper cables" which are used in a "battery jumping" procedure, i.e., to interconnect a charged battery with one of low charge.

Such procedure is probably most commonly used in respect to the task of starting a vehicle on occasions when the vehicle's battery has too low a charge, such as in cold weather, or after a battery has been permitted to lose its charge as by use of the vehicle's electrical devices without concurrent battery-charging.

Many of the public are no doubt unaware of the dangers to the person's face and body while doing this procedure, probably for several reasons. For one thing, the task is done many times by persons who have little or no knowledge of the technical workings of a battery, and thus no knowledge of the dangers; and thus they attempt the task in a hazardous manner which is obviated by the present invention.

Also, battery-jumping on such occasions is usually accomplished relatively easily and with no mishap, and this also tends to breed carelessness which can cause dangers which are avoided by this invention.

Still further, although there is a fairly safe method of battery-jumping taught in instruction manuals, many persons may be unaware of the safer procedures, whether due to lack of understanding, sheer laziness, over-confidence, etc.

Although battery-jumping mishaps are not expected and are perhaps not universally known, it has been reported that there are indeed a great many; e.g., there were more than 14,000 battery explosions in the year 1982, a vast majority of which no doubt occurred during battery-jumping procedures.

The cause involves the chemical action of the battery. That is, hydrogen gas is evolved in the reaction of the acid and the battery plates; and on occasions in which the hydrogen gas is adjacent the battery's connection terminals and is not sufficiently dissipated in the air, the smallest spark in a jumper-connection or jumper-disconnection procedure can cause an ignition of that gas, catastrophies of dirigibles and other explosions being examples of the violence of combustion of hydrogen gas with the air's oxygen. And, who of the automobile-driving public has not ever noticed a sparking during some battery-jumping activity?

In carrying out the invention as briefly and introductorily described, a set of battery cables are provided with a safety switch intermediate the cable-ends. It has an electrically conductive or "on" setting, and an electrically non-conductive or "off" setting of its parts; and it is kept in its "off" setting until the cable-ends are securely attached to the donor battery and receiver battery. Then, after the user is positioned in a safe distance away from both batteries, i.e., at the location of the safety switch component rather than at the location of either battery, an easy and simple relative movement of two body-portions of the safety switch establishes the "on" or electrically conductive nature of the cable set, but with the user then being in a position of safety.

The above description is of somewhat introductory and generalized form. More particular details, concepts, and features are set forth in the following and more detailed description of an illustrative embodiment, taken in conjunction with the accompanying drawings, which are of somewhat schematic and diagrammatic nature for showing of the inventive concepts.

In the drawings:

FIG. 3 is an end elevation view of the end of the male switch body which, when the switch means is assembled, is adjacent the female switch body;

FIG. 4 is a longitudinal cross-sectional view of the male switch body, shown generally as taken on Section-line 4—4 of FIG. 3, that being noted as being a so-called "broken" Section-line, and thus the sectional view of FIG. 4 is a so-called "revolved" Section;

FIG. 5 is a longitudinal cross-sectional (revolved-Section) view similar to that of FIG. 4 but of the female switch body, it being a revolved Section as would be taken by (broken) Section-line 5—5 of FIG. 6;

FIG. 6 is a view of the female switch body, generally corresponding to that of FIG. 3 as to the male switch body, but shown as taken by Section-line 6—6 of FIG. 5 rather than an end elevation view, so as to more clearly illustrate the interconnection means of the male and female switch bodies;

Figure 1:
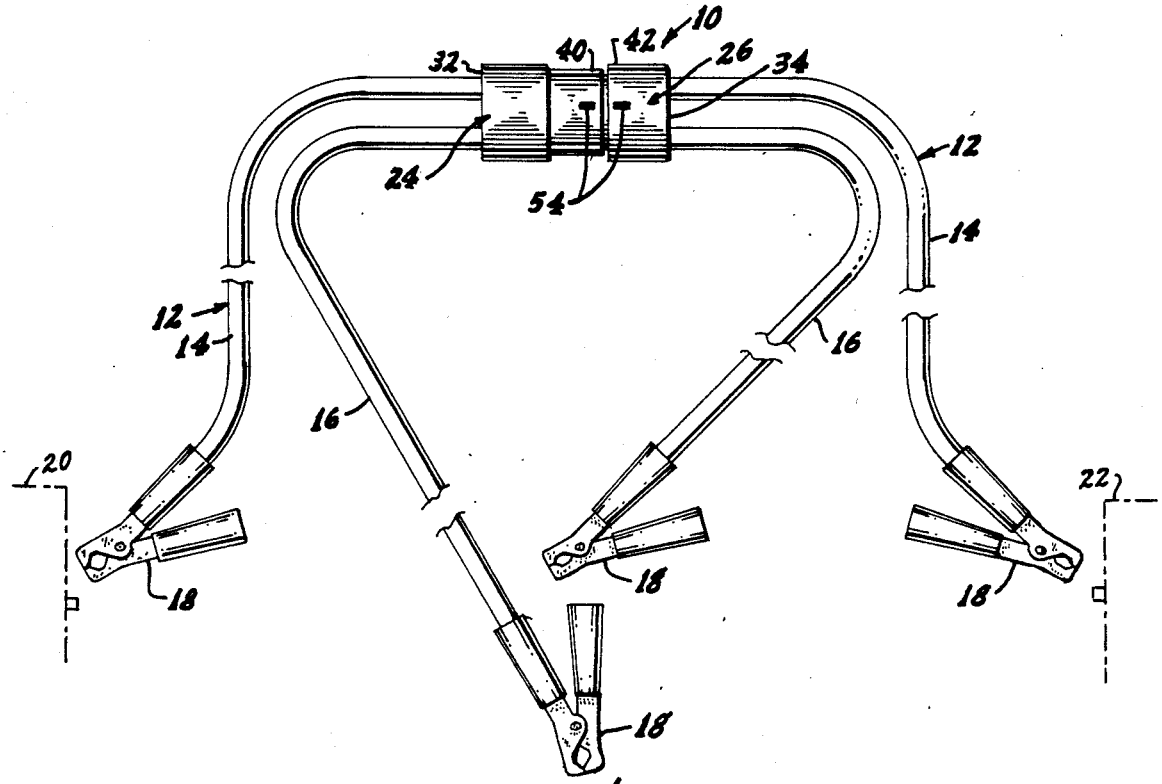
FIG. 1 is a pictorial view of a set of jumper cables having a battery cable safety switch means assembled onto the cables, the safety switch component bodies being relatively adjusted to an "off" or non-conductive setting prior to installation onto the batteries.
Figure 2:
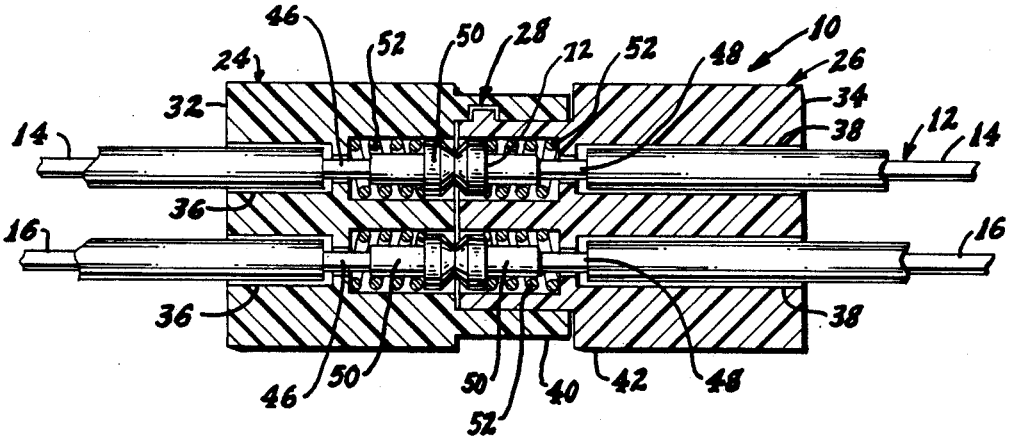
FIG. 2 is a longitudinal cross-sectional view (in considerably larger scale) of the safety switch means of FIG. 1, the component bodies thereof shown in this view as having been adjusted to an "on" position of electrical conductivity; and the Section is taken through the cables to illustrate that setting.
Figure 3:
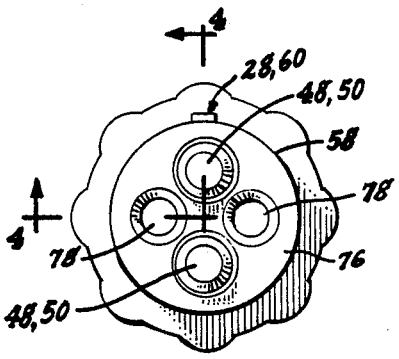
FIGS. 3–8 are in the same scale as FIG. 2; and, in those views.
Figure 4:
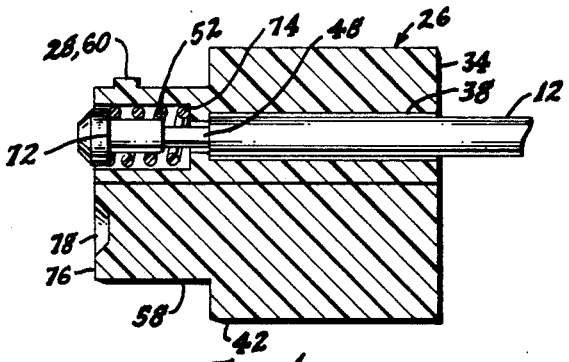
Figure 5:
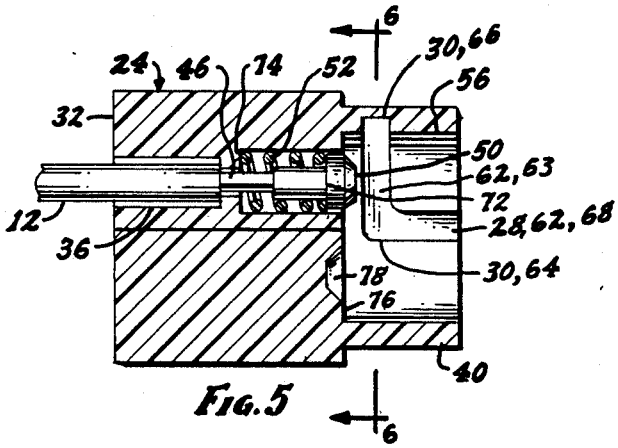
Figure 6:
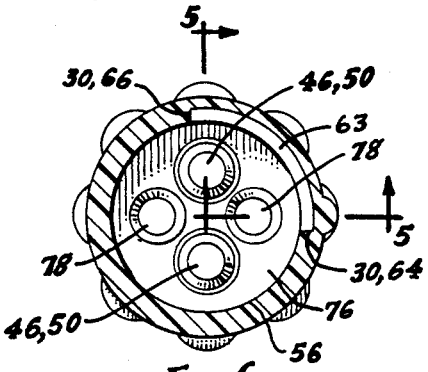
Figure 8:
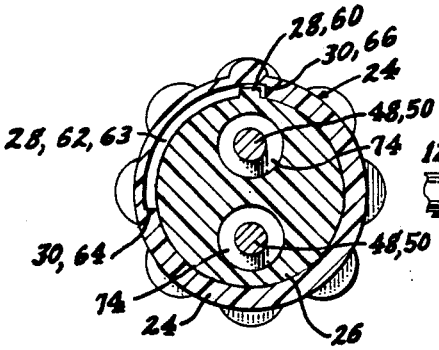
Figure 7:
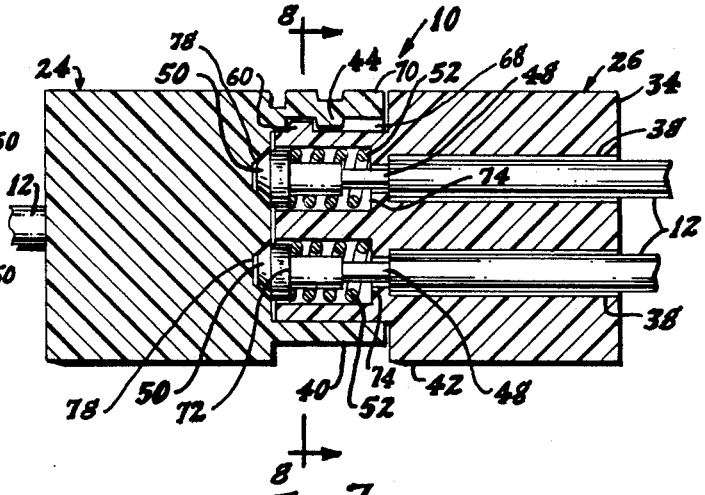

FIG. 7 is a longitudinal cross-sectional view of the safety switch means of FIGS. 1 and 2, but, in contrast to FIG. 2, the component bodies here are shown in this view as having been adjusted to the "off" or FIG. 1 position of electrical non-conductivity; and also in contrast to FIG. 2, here the portion of the female switch body which overlies the male switch body has been deformed to achieve a lug for retention of the male switch body and female switch body in assembled relationship against separability; and FIG. 8 is a transverse cross-sectional view, generally as shown by Section-line 8—8 of FIG. 7, although with the springs removed.

As illustrated in the accompanying drawings, the invention and its concepts provide a battery cable safety means 10 for a set of battery "jumper" cables 12 having a pair of cables 14 and 16. Such a set of cables 12 for "battery jumping" use has at each end of the set 12 a releasable connector 18 used for temporary operative attachment of the cables 12 respectively to the terminals of a donor battery 20 and a receiver battery 22 which are the co-operating batteries in a battery-jumping procedure.

As shown, the safety means 10 comprises a first body member 24 and a second body member 26, and interconnection means 28 which provide the operativity of the first body member 24 and the second body member 26 being interconnected physically against separation but are rotatably movable relative to one another in and between a first relative position and a second relative position for electrically conductive and electrically non-conductive operativity, respectively, as specified herein.

There are co-operative abutment means 30 which are provided for each of the first body member 24 and the second body member 26 which block the relative rotation thereof to be less than 180° between the first relative position and the said second relative position; and the entirety of the relative movement is of that relatively small angular rotation, making it quite handy for the user to relatively rotate the body members 24–26 to achieve the desired electrical setting of the safety means 10, i.e., either electrically conducting or non-conducting, in the electric switch function of the safety means 10.

For assembly of the portions of the cables 14 and 16 of the cable set 12 and the body members 24–26, the axially outwardly-facing or non-adjacent ends 32 and 34, respectively, of the first body member 24 and the second body member 26, are provided with opening means, respectively 36 and 38, through which extend the pair of cables 14–16 from a respective one of the batteries 20–22.

The axially inwardly-facing or adjacent ends 40 and 42, respectively, of the first body member 24 and of the second body member 26 are provided with co-operative abutment means 44 which provide the non-separability of the first body member 24 and the second body member 26, yet permit the relative rotatable movement thereof in and between the above-mentioned first relative position and the second relative position. (The non-separability means 44 (FIG. 7) are detailed below.)

The cables 14 and 16 of the set 12 are shown as both being discontinuous at adjacent ends 46–48 in the region of the adjacent ends 40–42 of the first body member 24 and second body member 26; but each of those adjacent ends 46–48 of the cables 14–16 of set 12 are provided with contact means 50 as herein detailed.

Spring means 52 are provided for at least one of the adjacent cable-ends 46–48 of each of the said pair of cables 14–16; and the spring means 52 are operative to assure forceful and electrically conductive contact between the adjacent cable-ends contact means 50 when the first body member 24 and the second body member 26 are relatively rotated such that said cable-ends contact means 50 are in registration; and this is the condition of the safety device 10 when in what is referred to as the first relative position of the first body member 24 and the second body member 26, in which the switch 10 is in an "on" or electrically-conductive setting, in which the circuit between bodies 24–26 is closed.

As to actuation for selection of the electrical setting of the device 10, into non-conductive setting, the relative rotatable movement of the first body member 24 and the second body member 26 is such that in what is referred to as the second relative position of the first body member 24 and the second body member 26 the contact means 50 of the adjacent ends 46–48 of the cables 14–16 of set 12 are out of registration; and thus they are non-conductive electrically, providing an "off" or "open" condition of the switch device 10.

Desirably as shown the first body member 24 and the second body member 26 are shown provided with indicator means 54 which visually indicate which of the first relative position (switch-closed) or second relative position (switch-open) is the relative position of the first body member and second body member, thus visually signalling to the user the electrical setting of the switch 10. The indicator 54 is shown by adjacent marks on the face of body members 24–26.

It will be noted in the form shown in the drawings that the adjacent ends 40 and 42 of the first body member 24 and second body member 26 are provided with generally cylindrical faces 56 and 58, respectively; and these faces 56–58 nest together in a male/female connection, the nesting portions of which are provided with the co-operating abutment means 28 on their nesting faces 56–58.

Further in the form shown, it will be noted that the interconnection means 28 comprise a bayonet joint; and for the nesting faces 56–58, there is a lug 60 outstanding from the end of the male one of the body members, and there is provided an inwardly-opening groove 62 on the end of female one of the body members which faces the male body member. (The female body is shown as 24 and the male body as 26.)

This groove 62 is noted as having a circumferentially-directed component 63, the ends 64 and 66 of which provide the abutment means 30 which block relative rotation to be less than 180° as mentioned above. Further, the groove 62 also has an axially-directed component 68 which provides an access throat by which the male body member lug 60 may reach the circumferentially-directed component 63 of the groove 62 during assembly of the first body member 24 and the second body member 26.

There is also shown the abutment 44 which blocks relatively axially-outward movement of the male body member lug 60 once the first body member and the second body member have been assembled, thus providing the interconnection against separation of the first body member 24 and the second body member 26. Economically, the abutment 44 is formed by a heat-deformation of the plastic.

The wall of the female body member in the region of the above-mentioned access throat 68 is radially enlarged (70) to provide support to compensate for the weakening which otherwise would occur due to the presence of the access throat 68.

Spring means 52 are provided for all four of the cable ends 46–48 of the safety means 10; and the contact means 50 for each cable-end 46–48 is provided as a contact terminal having an axially-outwardly-facing shoulder 72, and the body member through which extends each respective cable 14–16 which is spring-pressed is provided with a wall means 74 facing the other body member, and the respective spring means 52 is a compression spring which is shown bottomed respectively against that wall means 74 and the axially-outwardly-facing shoulder 72 of the respective contact terminal 50.

In the form shown, the opening means 36–38 through which extends one or both of the cable 14,16 which is/are spring-pressed provides a free and axially-movable fit as to the respective cable 14,16 passing therethrough; and desirably all of the opening means 36–38 provide a free and axially-movable fit of the respective cable 14,16 passing therethrough.

Further, it will be noted that the opening means 36–38 of the first body member 24 and of the second body member 26 are such as to provide that the cable-ends 46–48 and their respective contact means 50 from each pair of cables 14–16 coming from a respective battery connector 18 are diametrically offset.

As shown, at least the one of the first and second body members 24–26 which carries a spring-pressed contact means 50 is provided with a face 76 which faces the other of those body members; and that face 76 is provided with a recess means 78 which is adjacent the opening means 36 and/or 38 through which passes the cable end 46 and/or 48 having a spring-pressed contact means 50.

That recess means 78 is such as to open toward the other body member (24 or 26) and is displaced circumferentially with respect to the opening means 36–38 through which pass the respective cable end 46–48; and thus the recess means 78 provides a detent means which assures a continuation of the first and second body members 24–26 in their said second position of electrical non-conductivity once the first body member 24 and the second body member 26 are relatively moved into that second or open-circuit position.

Desirably, as shown, both the first body member 24 and the second body member 26 are provided with faces 76 which respectively face the other of body members 24–26, and each such face 76 is provided with a recess means 78 adjacent each of the opening means 36–38 through which a cable-end 46–48 passes; and this provides for desired switch-on and switch-off operativity as to each of the cables 14 and 16, thereby improving safety by making it a matter of indifference which of the cables 14–16 is connected to the positive battery terminals and which one of the cables is connected to the negative terminals.

It is thus seen that a set of jumper cables according to the inventive concepts provides a desired and advantageous device yielding the advantages high of safety but also great convenience, with the actuation between the "on" and "off" settings being so easy that the user is encouraged toward the safety of making connections to the batteries only when the device is in its non-conducting setting, yet the contacts are quite rugged and spring-pressed, assuring good jumper cable operativity and long life of the set.

Accordingly, it will thus be seen from the foregoing description of the invention according to this illustrative embodiment, considered with the accompanying drawings, that the present invention provides new and useful concepts in combination, which provide and achieve a novel and advantageous jumper cable set, with a desired switch device carried intermediate the cable-ends, with high advantages of both convenience and safety, and accommodation to various sizes and lengths of jumper cables, and yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment of form or arrangement of parts herein described or shown.

What is claimed is:

1. Jumper cable safety means, for a set of battery jumper cables having a pair of cables, at each end of which is a releasable connector for temporary operative attachment of the cables respectively to the terminals of a donor battery and a receiver battery which operatively co-operate in a battery-jumping procedure, the safety means comprising:

a first body member and a second body member, interconnection means which provide that the first body member and the second body member are interconnected against separation but are rotatably movable relative to one another in and between a first relative position and a second relative position; and when so connected, the first body member and the second body member each have an axially inwardly-facing end, those ends being relatively adjacent one another, and they both have an axially outwardly-facing end, those ends being relatively non-adjacent to one another;

there being co-operative abutment means provided for each of the first body member and second body member which block the relative rotation thereof to be less than 180° between said first relative position and said second relative position, the non-adjacent ends of the first body member and the second body member being provided with opening means through which extend the pair of cables from a respective one of the batteries, the adjacent ends of the first body member and second body member being provided with co-operative abutment means which provide said non-separability of the first body member and second body member, yet permit said relative rotatable movement thereof in and between said first relative position and said second relative position, the cables being discontinuous at adjacent ends in the region of the adjacent ends of the first body member and second body member, each of said adjacent ends of the cables being provided with contact means, there being spring means for at least one of the adjacent cable-ends of each of said pair of cables, the spring means being operative to assure forceful and electrically conductive contact between the adjacent cable-ends contact means when the first body member and second body member are relatively rotated such that said cable-ends contact means are in registration, this being said first relative position of the first body member and the second body member, the relative rotatable movement of said first body member and second body member being such that in said second relative position of the first body member and second body member the contact means of said adjacent ends of the cables are out of registration and thus non-conductive electrically, thereby providing safety by providing that the electrical conductivity of the cables is blocked except when the user, in a position of safety removed from the location of connection of the cables to either battery, moves the switch components to electrically-conducting condition by manual manipulation at such position of safety away from the location of either battery.

2. The battery cable safety means as set forth in claim 1, in which the interconnection means comprise a bayonet joint.

3. The battery cable safety means as set forth in claim 1, in which the contact means for each cable-end is provided as a contact terminal having an axially-outwardly-facing shoulder, the body member through which extends each respective cable which is spring-pressed being provided with a wall means facing the other body member, and the respective spring means being a compression spring bottomed respectively against said wall means and said axially-outwardly-facing shoulder of the respective contact terminal.

4. The battery cable safety means as set forth in claim 1, in which the opening means through which extends a cable which is spring pressed provides a free and axially-movable fit of the respective cable passing therethrough.

5. The battery cable safety means as set forth in claim 1, in which at least the one of said first and second body members which carries a spring-pressed contact means is provided with a face which faces the other of said body members, said face being provided with a recess means adjacent the opening means through which passes the cable end having a spring-pressed contact means, said recess means being such as to open toward the other body member and being displaced circumferentially with respect to the opening means through which the respective cable end passes, the recess means thus providing a detent means which assures a continuation of the first and second body members in their said second position of electrical non-conductivity once the first body member and second body member are relatively moved into said second position.

6. The battery cable safety means as set forth in claim 1, with the addition of the first body member and the second body member being provided with indicator means which visually indicate which of the first relative position or second relative position is the relative position of the first body member and second body member.

7. The battery cable safety means as set forth in claim 1, in a combination in which the adjacent ends of the first body member and second body member are formed to provide respectively a female body member and a male body member which respectively have generally cylindrical nesting faces which nest together in a male/-female connection, their nesting faces being provided with said co-operating abutment means.

8. The battery cable safety means as set forth in claim 7, in which the opening means of the first body member and second body member are such as to provide that the cable-ends and their respective contact means, from each pair of cables coming from a respective battery connector, are diametrically offset.

9. The battery cable safety means as set forth in claim 7, in which the interconnection means comprise a bayonet joint, including the provision, for their nesting faces, of a lug outstanding from the male body member end and the provision of an inwardly-opening groove on the female body member end, the groove having a circumferentially-directed component, the ends of which provide the abutment means which block relative rotation to be less than 180°.

10. The battery cable safety means as set forth in claim 9, in which said groove also has an axially-directed component which provides an access throat by which the male body member lug may reach the circumferentially-directed component of the groove during assembly of the first body member and the second body member.

11. The battery cable safety means as set forth in claim 10, in which an abutment is provided which blocks relatively axially-outward movement of the male body member lug once said first body member and said second body member have been assembled, thus providing the interconnection against separation of the first body member and the second body member.

12. The battery cable safety means as set forth in claim 10, in which the female body member end is provided with an inwardly-facing wall which provides its said nesting face, and its inwardly-opening groove is provided as a recess in that face of said female body member, and the wall of the female body member in the region of said access throat is radially enlarged to provide support to compensate for the weakening which otherwise would occur due to the presence of said access throat.

13. The battery cable safety means as set forth in claim 1, in which spring means are provided for all four of the cable ends of the safety means.

14. The battery cable safety means as set forth in claim 13, in which all of the opening means provide a free and axially-movable fit of the respective cable passing therethrough.

15. The battery cable safety means as set forth in claim 13, in which both the first body member and the second body member are provided with faces which respectively face the other of said body members, and each face is provided with a recess means adjacent each of the opening means through which a cable-end passes, said recess means being such as to open toward the other body member and being displaced circumferentially with respect to the opening means through which the respective cable end passes, the recess means thus providing a detent means which assures a continuation of the first and second body members in their said second position of electrical non-conductivity once the first body member and second body member are relatively moved into said second position.

16. The battery cable safety means as set forth in claim 13, in which the contact means for each cable-end is provided as a contact terminal having an axially-outwardly-facing shoulder, the body member through which extends each respective cable which is spring-pressed being provided with a wall means facing the other body member, and the respective spring means being a compression spring bottomed respectively against said wall means and said axially-outwardly-facing shoulder of the respective contact terminal.

17. The battery cable safety means as set forth in claim 16, in which all of the opening means provide a free and axially-movable fit of the respective cable passive therethrough.

* * * * *